US009893496B2

(12) United States Patent
Thomson et al.

(10) Patent No.: US 9,893,496 B2
(45) Date of Patent: Feb. 13, 2018

(54) SPARK PLUG HAVING IMPROVED GROUND ELECTRODE ORIENTATION AND METHOD OF FORMING

(71) Applicant: FEDERAL-MOGUL CORPORATION, Southfield, MI (US)

(72) Inventors: Nathan A. Thomson, Southgate, MI (US); Kevin J. Kowalski, Cambridge, OH (US); Jeremy M. Bowman, Livonia, MI (US)

(73) Assignee: Federal-Mogul LLC, Southfield, MI (US)

( * ) Notice: Subject to any disclaimer, the term of this patent is extended or adjusted under 35 U.S.C. 154(b) by 0 days.

(21) Appl. No.: 15/417,007

(22) Filed: Jan. 26, 2017

(65) Prior Publication Data

US 2017/0141543 A1 May 18, 2017

Related U.S. Application Data

(60) Continuation-in-part of application No. 14/875,277, filed on Oct. 5, 2015, now abandoned, which is a (Continued)

(51) Int. Cl.
*H01T 21/02* (2006.01)
*H01T 13/08* (2006.01)
(Continued)

(52) U.S. Cl.
CPC ..... *H01T 13/08* (2013.01); *H01T 21/02* (2013.01); *H01T 13/12* (2013.01); *H01T 13/32* (2013.01)

(58) Field of Classification Search
CPC ..... H01T 13/08; H01T 13/04; H01T 13/12; H01T 13/32; H01T 13/38; H01T 13/39
See application file for complete search history.

(56) References Cited

U.S. PATENT DOCUMENTS 8,834,224 B2 9/2014 Ozeki et al.
8,866,369 B2 10/2014 Gfell et al.
(Continued)

FOREIGN PATENT DOCUMENTS

EP 1965475 A1 * 9/2008 ..... H01T 13/08
JP 04329287 A * 11/1992
(Continued)

*Primary Examiner* — Mariceli Santiago
(74) *Attorney, Agent, or Firm* — Robert L. Stearns; Dickinson Wright, PLLC

(57) ABSTRACT

A method of manufacturing a spark plug (20) for being threaded into a cylinder head (28) of an internal combustion engine is provided. The spark plug (20) includes a shell (24) with threads (26) disposed at a predetermined rotational position (a) relative to a shell outer surface (64) and ground electrode (34). The position of the threads (26) relative to the ground electrode (34) places the ground electrode (34) in a desired position in the combustion chamber (22) and relative to components of the engine, thus allowing the ground electrode (34) to provide a robust and reliable ignition. When multiple spark plugs (20) are formed, the threads (26) in each of the shells (24) are repeatedly and accurately formed at the predetermined rotational position (α) by locating the ground electrode (34), threads (26), and dies (76) of a thread forming apparatus (102) in specific locations.

20 Claims, 9 Drawing Sheets

Related U.S. Application Data continuation of application No. 14/518,166, filed on Oct. 20, 2014, now Pat. No. 9,236,713, which is a division of application No. 13/350,140, filed on Jan. 13, 2012, now Pat. No. 8,866,369.

(60) Provisional application No. 61/432,403, filed on Jan. 13, 2011.

(51) Int. Cl.
*H01T 13/12* (2006.01)
*H01T 13/32* (2006.01)

(56) References Cited

U.S. PATENT DOCUMENTS

| | | | |
|---|---|---|---|
| 9,236,713 | B2 | 1/2016 | Gfell et al. |
| 2016/0049772 | A1 | 2/2016 | Gfell et al. |

FOREIGN PATENT DOCUMENTS

| | | | | |
|---|---|---|---|---|
| JP | 2001284015 | A | * | 10/2001 |
| JP | 2003323963 | A | * | 11/2003 |
| JP | 2010129520 | A | * | 6/2010 |

* cited by examiner

SPARK PLUG HAVING IMPROVED GROUND ELECTRODE ORIENTATION AND METHOD OF FORMING

CROSS REFERENCE TO RELATED APPLICATION

This U.S. continuation-in-part patent application claims the benefit of U.S. continuation application Ser. No. 14/875,277, filed Oct. 5, 2015, which claims the benefit of U.S. divisional application Ser. No. 14/518,166, filed Oct. 20, 2014, which claims the benefit of U.S. application Ser. No. 13/350,140, filed Jan. 13, 2012, now U.S. Pat. No. 8,866,369, which claims the benefit of U.S. provisional application Ser. No. 61/432,403, filed Jan. 13, 2011, the contents of which are incorporated herein by reference in its entirety.

BACKGROUND OF THE INVENTION

1. Field of the Invention

This invention relates generally to spark plugs for internal combustion engines, and methods of forming the same.

2. Related Art

Sparks plugs of internal combustion engines typically include a metal shell threaded into a bore of a cylinder head and extending into a combustion chamber for providing a spark to ignite a combustible mixture of fuel and air in the combustion chamber. The spark is provided between a central electrode and ground electrode, which should be properly positioned in the combustion chamber, in order to provide a reliable and robust ignition of the fuel-air mixture. Without the proper positioning, the spark may not provide a robust ignition, or may not provide any ignition of the fuel-air mixture.

SUMMARY OF THE INVENTION

One aspect of the invention provides a more accurate and repeatable method of threading a shell for a spark plug of an internal combustion engine.

According to one embodiment, the method includes providing a shell extending to a shell lower surface and including a shell outer surface, wherein the shell includes a shell seat presenting a ledge facing the shell lower surface; and providing a ground electrode extending longitudinally from an attachment surface. The attachment surface of the ground electrode is attached to the shell lower surface before disposing the shell and the ground electrode in a thread forming apparatus. The method also includes determining the start position of the threads in the shell outer surface relative to the ledge of the shell seat. The step of determining the start position is based on a desired location of the shell in the cylinder head. The method further includes determining a predetermined rotational position of the threads in the shell outer surface. The method then includes placing the shell and the attached ground electrode between a set of threading dies of the thread forming apparatus so that the ledge of the shell seat is at a specified distance relative to a start position of the threads of the threading dies. The method also includes placing the ground electrode at a known rotational position in relation to a start position of the threads to be formed in the shell outer surface by the threading dies. The method then includes rotating the threading dies to form the threads at the predetermined rotational position in the shell outer surface According to a second embodiment, a method of threading at least one shell includes providing a shell extending to a shell lower surface and including a shell outer surface, the shell including a shell seat presenting a ledge facing the shell lower surface; and providing a ground electrode extending longitudinally from an attachment surface. The attachment surface of the ground electrode is attached to the shell lower surface before disposing the shell and the ground electrode in a thread forming apparatus. The method further includes determining a start position of the threads to be formed by threading dies of the thread forming apparatus, wherein the start position is based on a desired location of the shell in a cylinder head in which the shell will be used. The method next includes disposing the shell and the attached ground electrode between the threading dies of the thread forming apparatus, wherein the step of disposing the shell between the threading dies includes engaging the ledge of the shell seat with a surface disposed at a specified distance relative to the start position of the threads. The method also includes determining a predetermined rotational position of the threads in the shell outer surface in relation to the rotational location of the of the ground electrode. The method then includes rotating the threading dies and forming the threads at the predetermined rotational position in the shell outer surface.

According to a third example embodiment, a method of threading at least one shell includes providing a shell extending to a shell lower surface and including a shell outer surface, wherein the shell includes a shell seat presenting a ledge facing the shell lower surface; and providing a ground electrode extending longitudinally from an attachment surface. The method next includes determining the longitudinal location of the ledge of the shell seat, which is the distance between the shell lower surface and the ledge. The method further includes placing the shell and the attached ground electrode between a set of threading dies of the thread forming apparatus so that the ledge of the shell seat is at a specified distance relative to a start position of the threads of the threading dies. The step of placing the ledge of the shell seat at the specified distance relative to the start position of the threads includes disposing the shell lower surface on a solid adjustment feature located between the dies, and adjusting the longitudinal position of the solid adjustment feature relative to the start position of the threads of the dies. The method also includes placing the attached ground electrode at a known rotational position in relation to a starting position of the threads of the threading dies. The method next includes rotating the threading dies to form the threads at the predetermined rotational position in the shell outer surface.

Another aspect of the invention includes a method of manufacturing at least one spark plug for an internal combustion engine and including the threaded shell manufactured according to the method of the first, second, or third embodiment. Yet another aspect of the invention provides a method of manufacturing an internal combustion engine including a spark plug with the threaded shell manufactured according to the first, second, or third embodiment. Other aspects of the invention provide a threaded shell manufactured according to the method of the first, second, or third embodiment; a spark plug including a threaded shell manufactured according to the method of the first, second, or third example embodiment; and an internal combustion engine including a threaded shell manufactured according to the method of the first, second, or third example embodiment.

When the shell is threaded into the cylinder head, the ground electrode of the spark plug is oriented in a desired position in the combustion chamber relative to the cylinder head and other components in the combustion chamber. The position of the ground electrode allows the spark plug to provide a more reliable and efficient ignition of the fuel-air mixture.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF EXAMPLE EMBODIMENTS

Figure 1:
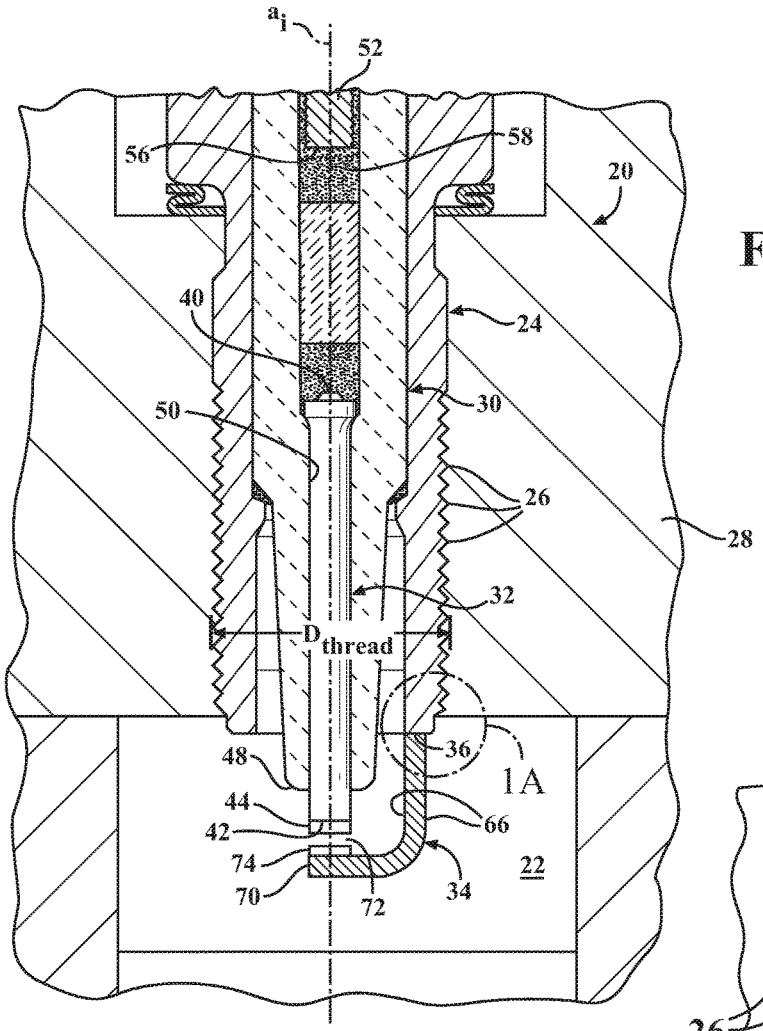
FIG. 1 is a cross sectional view of a spark plug threaded in a cylinder head according to one embodiment of the invention.

One aspect of the invention provides a spark plug 20 for providing a spark to ignite a combustible mixture of fuel and air of combustion chamber 22. The spark plug 20 includes a metal shell 24 with threads 26 attached to a component having mating threads, typically a cylinder head 28 of an internal combustion engine. The shell 24 of the spark plug 20 surrounds an insulator 30 and a central electrode 32. A ground electrode 34 is attached to a shell lower surface 36, as shown in FIG. 1. The threads 26 are formed in a predetermined location and at a predetermined angle $\alpha$ relative to the ground electrode 34. By forming the threads 26 of the shell 24 in the predetermined location relative to the ground electrode 34, the spark plug 20 can be oriented in a desired position relative to the cylinder head 28 and other components in the combustion chamber, such as the fuel injector, allowing the spark plug 20 to provide a more reliable and efficient ignition of the fuel-air mixture. Another aspect of the invention provides a method of forming the spark plug 20 using an orientation tool 38 to locate the ground electrode 34 and align the shell 24 such that the threads 26 are formed in the predetermined location relative to the ground electrode 34.

Figure 8:
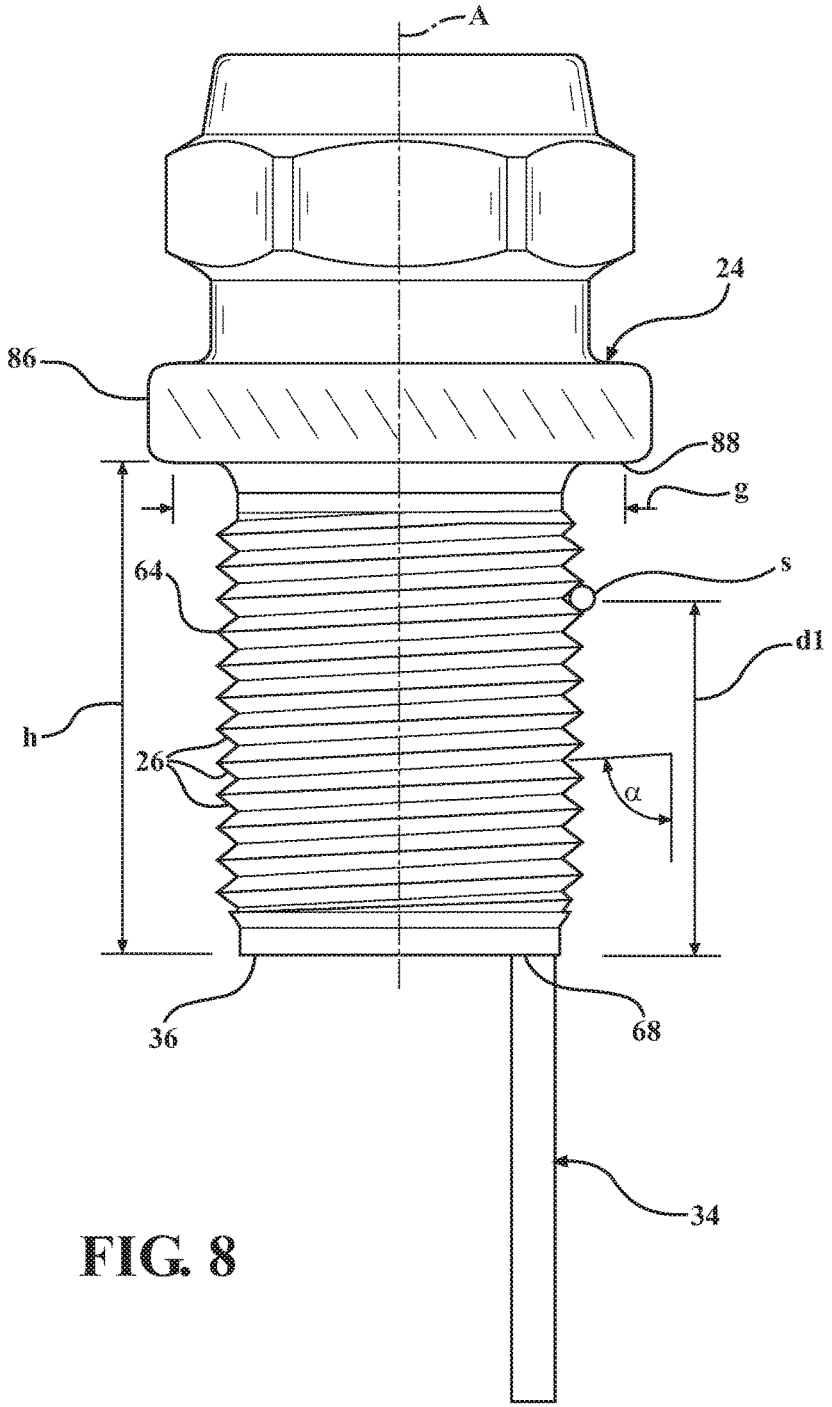
FIG. 8 is a side view of an example threaded shell and ground electrode formed according to a first, second, or third alternate method.

The central electrode 32 is formed of an electrically conductive material extending longitudinally along an igniter central axis $a_i$ from an electrode terminal end 40 to a central firing end 42. In one embodiment, the electrically conductive material of the central electrode 32 is a nickel-based material including nickel in an amount of at least 60.0 wt. %, based on the total weight of the nickel-based material. The central electrode 32 can also include a central firing tip 44 formed of a precious metal alloy disposed on the central firing end 42, as shown in FIGS. 1 and 8, to provide the spark.

An insulator 30 formed of an electrically insulating material, such as alumina, surrounds the central electrode 32 and extends longitudinally along the igniter central axis $a_i$ from an insulator upper end (not shown) to an insulator nose end 48 such that the central firing end 42 is disposed outwardly of the insulator nose end 48. The insulator 30 includes an insulator bore 50 extending along the igniter central axis $a_i$ for receiving the central electrode 32.

The spark plug 20 also includes a terminal 52 formed of an electrically conductive material received in the insulator 30 and extending longitudinally along the igniter central axis $a_i$ from a first terminal end (not shown), which is electrically connected ultimately to a power source, to a second terminal end 56, which is electrically connected to the electrode terminal end 40. A resistor layer 58 is disposed between and electrically connects the second terminal end 56 and the electrode terminal end 40 for transmitting energy from the terminal 52 to the central electrode 32. The resistor layer 58 is formed of an electrically resistive material, such as a glass seal.

The metal shell 24, typically formed of steel, surrounds the insulator 30 and extends longitudinally along the igniter central axis $a_i$ from a shell upper surface 60 to the shell lower surface 36 such that the insulator nose end 48 extends outwardly of the shell lower surface 36, as shown in FIG. 1. In one preferred embodiment, the shell lower surface 36 is planar and presents a shell thickness $t_s$ extending perpendicular to the igniter central axis $a_i$. The shell lower surface 36 also extends annularly around the insulator 30.

The shell 24 includes a shell inner surface 62 facing the insulator 30 and a shell outer surface 64 facing opposite the shell inner surface 62. The shell inner surface 62 and shell outer surface 64 extend circumferentially around the igniter central axis $a_i$ and longitudinally between the shell upper surface 60 and the shell lower surface 36. The shell inner surface 62 presents a shell inner diameter $D_i$ and the shell outer surface 64 presents a shell outer diameter $D_o$, each extending across the igniter central axis $a_i$.

The shell outer surface 64 presents the plurality of threads 26 extending circumferentially around the igniter central axis $a_i$ between the shell upper surface 60 and the shell lower surface 36 for engaging mating threads of the cylinder head 28 or another component maintaining the spark plug 20 in position in the end application. The threads 26 are formed after attaching the ground electrode 34 to the shell 24 such that the ground electrode 34 is disposed in the predetermined location relative to the threads 26 of the shell 24 and the threads 26 are disposed in the predetermined location relative to the ground electrode 34.

Figure 1A:
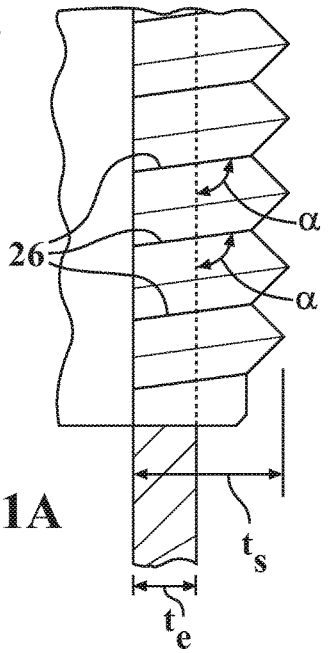
FIG. 1A is a side view of a portion of a shell including threads and an attached ground electrode with the threads disposed at a predetermined angle relative to the ground electrode according to one embodiment of the invention.

Each of the threads 26 present a thread diameter $D_{thread}$ across the igniter central axis $a_i$. The peak of each thread 26 is spaced from the peak of an adjacent thread 26. The peaks of the threads 26 are oriented in the predetermined location relative to the ground electrode 34, for example at a predetermined angle α relative to the side surface 66 of the ground electrode 34 adjacent the attachment surface 68, as shown in FIG. 1A. The angle α of the threads 26 can be determined by indexing methods. For example, the angle α can be determined by first locating the desired position of the shell 24 and ground electrode 34 when the spark plug 20 is disposed in the combustion chamber 22, which is typically the position providing the most effective combustion of the fuel-air mixture, and then determining an angle α of the threads 26 that can provide that desired position. In one embodiment, the peaks of the threads 26 are formed at an angle α plus or minus a certain degree from the side surface 66 of the ground electrode 34, as shown in FIG. 1A. The peaks of the threads 26 can also be formed at an angle a plus or minus a certain degree from a plane perpendicular to the igniter central axis $a_i$ and extending through a predetermined point P along the shell outer surface 64, for example the point P shown in the spark plug of FIGS. 8 and 8A. The threads 26 can also be formed at a predetermined distance from the attachment surface 68 of the ground electrode 34.

Figure 2:
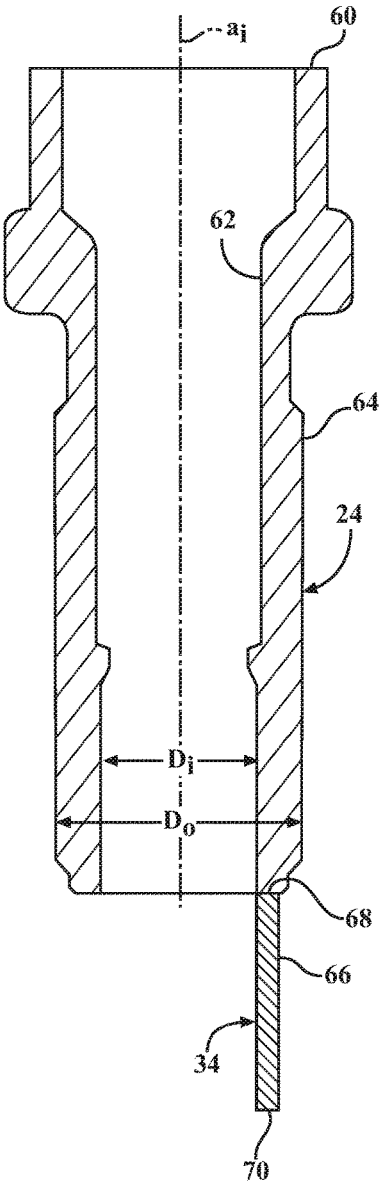
FIG. 2 is a cross-sectional view of a shell and ground electrode according to one embodiment of the invention before forming threads in the shell.

The ground electrode 34 is formed of an electrically conductive material, such as a nickel alloy, and extends from an attachment surface 68 to a ground firing surface 70 with a side surface 66 between the attachment surface 68 and the ground firing surface 70. The attachment surface 68 and firing surface 70 are planar and present an electrode thickness $t_e$ between the side surface 66. The electrode thickness $t_e$ is typically not greater than the shell thickness $t_s$. In one embodiment, the ground electrode 34 is initially provided as extending straight from the attachment surface 68 to the ground firing surface 70, as shown in FIG. 2. The attachment surface 68 is attached to the shell lower surface 36, typically by welding. The attachment surface 68 is disposed at a predetermined circumferential location along the shell lower surface 36 relative to the threads 26.

Typically after the threads 26 are formed in the shell outer surface 64, the ground electrode 34 is bent inwardly such that the ground electrode 34 curves and the ground firing surface 70 extends past the igniter central axis $a_i$. The ground firing surface 70 is spaced from the central firing end 42, such that the side surface 66 of the ground electrode 34 and the central firing end 42 provide a spark gap 72 therebetween. However, the ground electrode 34 can comprise another design while still being disposed at a predetermined angle α relative to the threads 26. In one embodiment, the ground electrode 34 includes a ground firing tip 74 formed of a precious metal alloy disposed on the ground firing surface 70 for providing the spark. The ground firing tip 74 is spaced from the central firing tip 44 to provide a spark gap 72 therebetween.

Another aspect of the invention provides a method of forming the spark plug 20 including the ground electrode 34 and shell 24 disposed in the predetermined location relative to one another, so that the spark plug 20 can be oriented in a desired position relative to the cylinder head 28 and other components of the internal combustion engine, allowing the spark plug 20 to provide a more reliable and efficient or optimal combustion of the fuel-air mixture. Before forming the spark plug 20, the method includes determining a location of threads 26 to be formed in the shell outer surface 64 relative to the ground electrode 34, such that when the spark plug 20 is threaded to the cylinder head 28, the ground electrode 34 is disposed in an optimal position for ignition. In one embodiment, the threads 26 are oriented at the predetermined angle α relative to the side surface 66 of the ground electrode 34 adjacent the attachment surface 68, as shown in FIG. 1A. The angle α of the threads 26 can be determined by indexing methods.

Figure 5:
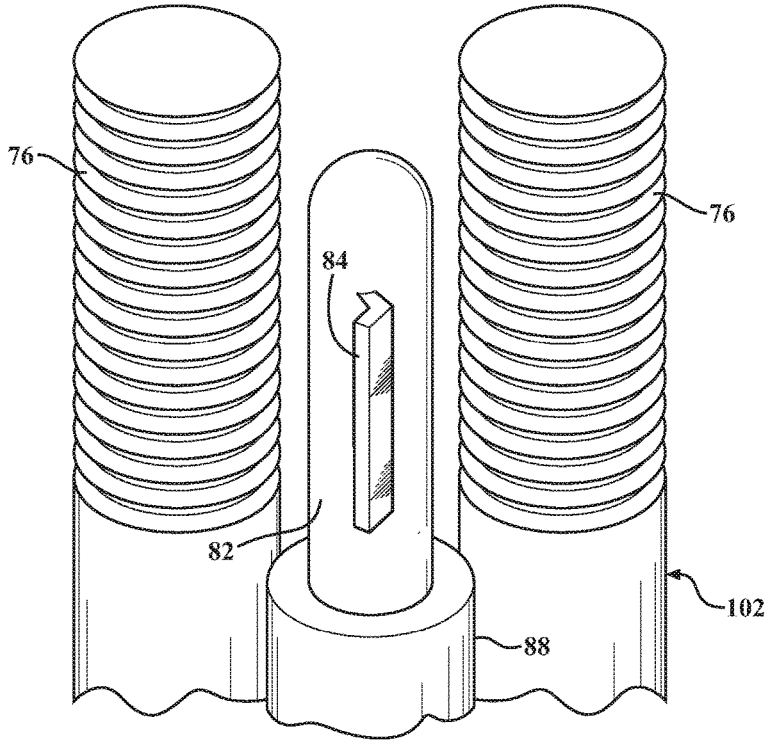
FIG. 5 is a perspective view of the orientation tool of FIG. 3 disposed in a thread forming apparatus according to one embodiment of the invention.
Figure 7:
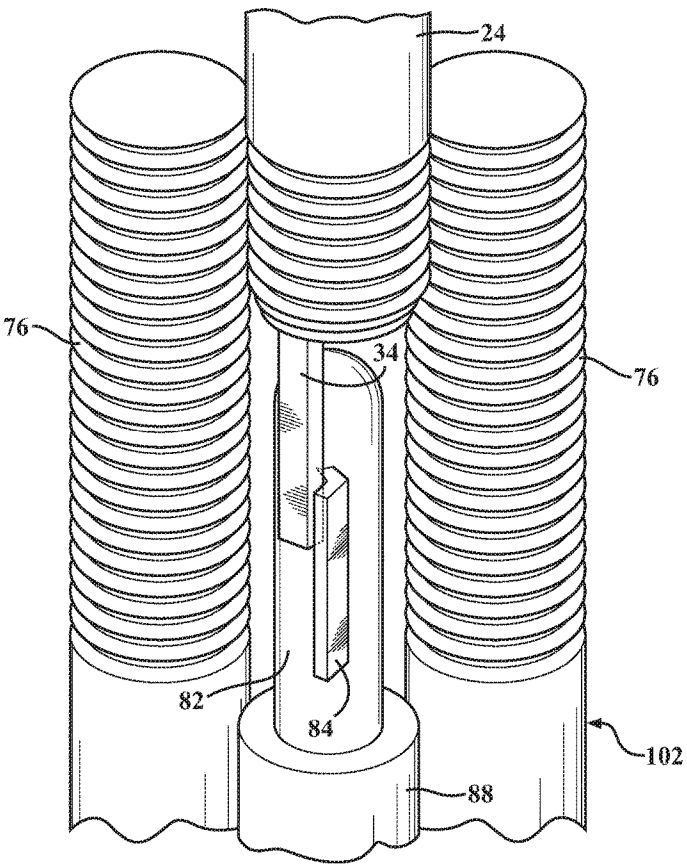
FIG. 7 is a perspective view of the shell and attached ground electrode disposed on the orientation tool of FIG. 5 after locating the ground electrode and before forming the thread.
Figure 6:
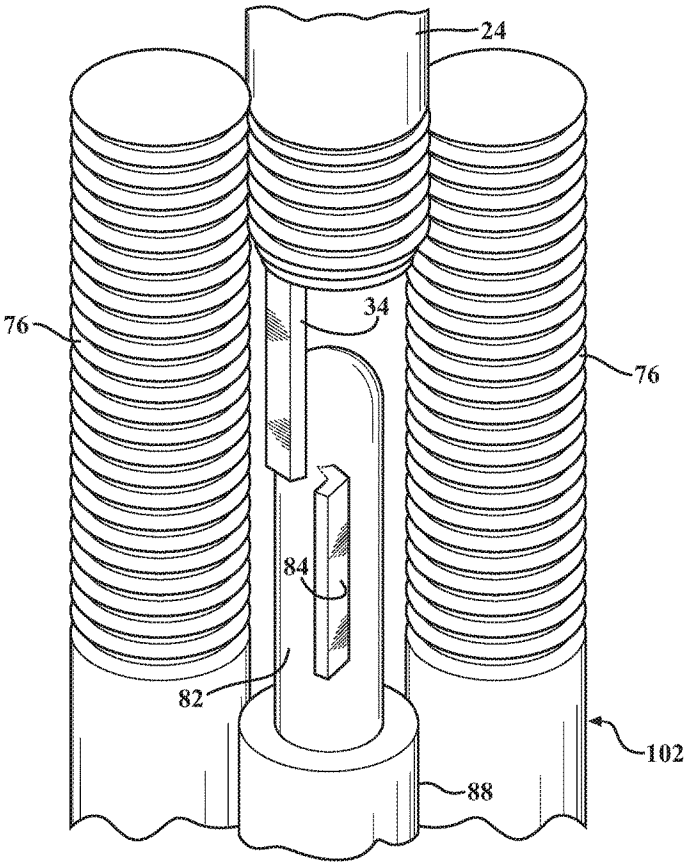
FIG. 6 is a perspective view of the shell and attached ground electrode disposed on the orientation tool of FIG. 5 before locating the ground electrode and forming the threads.

A thread forming apparatus 102 is used to form the threads 26 in the predetermined location, for example a thread roller including a plurality of thread dies 76, as shown in FIGS. 5-7. The thread forming apparatus 102 is designed to form the threads 26 in the predetermined location relative to the ground electrode 34 when the ground electrode 34 is disposed in a predetermined position relative to the thread forming apparatus 102, for example when the ground electrode 34 is disposed in a predetermined position relative to the opposing thread dies 76. The orientation tool 38 is preferably used to dispose the ground electrode 34 in the predetermined position relative to the thread forming apparatus 102.

The method of forming the spark plug 20 first includes providing the shell 24, ground electrode 34, and other components of the spark plug 20. The ground electrode 34 is initially provided as extending longitudinally and straight from the attachment surface 68 to the ground firing surface 70, as shown in FIG. 2. Before forming the threads 26 in the shell outer surface 64, the method includes attaching the attachment surface 68 of the ground electrode 34 to the shell lower surface 36 at a predetermined circumferential location along the shell lower surface 36.

Once the ground electrode 34 is attached to the shell 24, the orientation tool 38 is used to locate the ground electrode 34 and position the ground electrode 34 and the shell 24 in the thread forming apparatus 102. The orientation tool 38 may be mechanically coupled to the thread forming apparatus 102, as shown in FIGS. 5-7. Alternatively, the orientation tool 38 may be separate from the thread forming apparatus 102 and then placed along the thread forming apparatus 102 after locating the position of the ground electrode 34.

Figure 3:
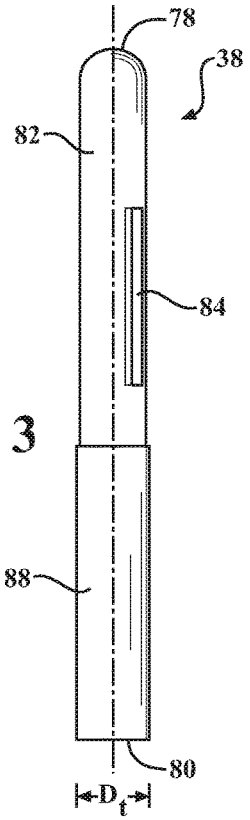
FIG. 3 is an illustration of an orientation tool according to one embodiment of the invention.

The orientation tool 38 typically extends longitudinally along a tool central axis $a_t$ from a first end 78 to a second end 80. The orientation tool 38 includes a tool outer surface 82 between the first end 78 and the second end 80 with a thread orientation feature 84 disposed in a predetermined location along the tool outer surface 82 and extending transverse to the tool outer surface 82. The orientation tool 38 presents a tool diameter $D_t$ that is no greater than the shell inner diameter $D_i$. In one embodiment, shown in FIG. 3, the orientation tool 38 includes a mandrel and the tool outer surface 82 presents a cylindrical shape. In this embodiment, the thread orientation feature 84 is a lip extending transversely from the tool outer surface 82. The mandrel is typically placed in a bore of a receptacle 88 and extends perpendicular to the thread dies 76, as shown in FIG. 5.

Figure 4:
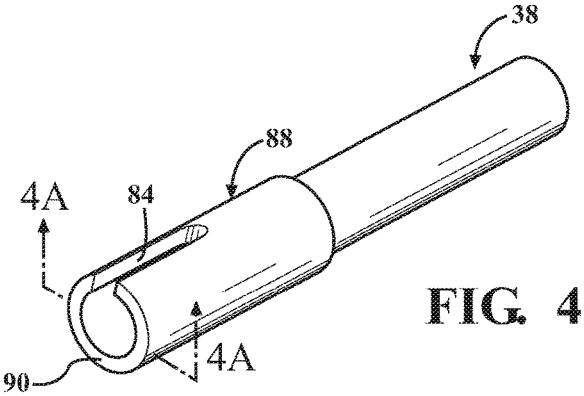
FIG. 4 is a perspective view of an orientation tool according to another embodiment of the invention.
Figure 4A:
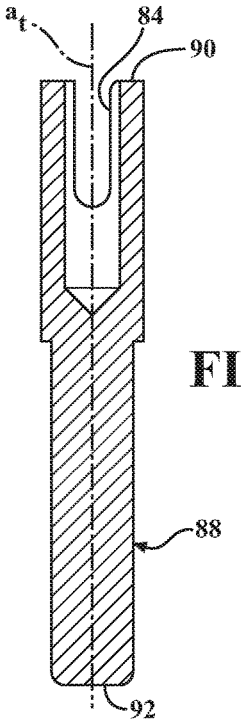
FIG. 4A is a side view of the orientation tool of FIG. 4.
Figure 4B:
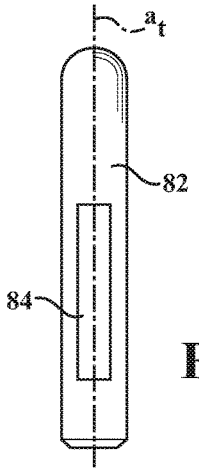
FIG. 4B is a cross sectional view of the orientation tool of FIG. 4.

In an alternate embodiment, shown in FIG. 4-4B, the orientation tool 38 includes a receptacle 88 extending longitudinally from a support surface 90 along a tool central axis $a_t$ to a base surface 92, wherein the support surface 90 is planar and extends annularly around the tool central axis $a_t$. In this embodiment, the orientation tool 38 also includes mandrel with a tool outer surface 82 that can be disposed in a bore of the receptacle 88 and presents a cylindrical shape. The mandrel presenting the tool outer surface 82 includes a flat disposed in a slot along the tool bore. The thread orientation feature 84 is provided by a surface of the slot extending from the support surface 90 toward the base surface 92 of the receptacle 88 and the flat of the mandrel. The slot surface is located in a predetermined location along the tool outer surface 82 and extends transverse to the tool outer surface 82.

The method also includes disposing the thread orientation feature 84 of the orientation tool 38 in a predetermined position relative to the thread forming apparatus 102, such that when the ground electrode 34 contacts the thread orientation feature 84 the thread forming apparatus 102 can form the threads 26 in the shell outer surface 64 in the predetermined location relative to the ground electrode 34. In the embodiment of FIGS. 5-7, the orientation tool 38 is mechanically attached to the thread forming apparatus 102. Thus, when the ground electrode 34 is maintained in contact with the thread orientation feature 84 of the orientation tool 38, the ground electrode 34 will be disposed in a predetermined position relative to the thread forming apparatus 102, allowing the thread forming apparatus 102 to form the threads 26 in the shell outer surface 64 in the desired location relative to the ground electrode 34. In another embodiment, the orientation tool 38 is separate from the thread forming apparatus 102, and the orientation tool 38 is transferred to the thread forming apparatus 102 with the shell 24 and ground electrode 34 maintained along the thread orientation feature 84.

To dispose the ground electrode 34 in the desired position, the method includes aligning the tool central axis $a_t$ of the orientation tool 38 with the igniter central axis $a_i$ of the shell 24 and disposing the shell 24 on the first end 78 of the orientation tool 38 such that the ground electrode 34 engages the tool outer surface 82, as shown in FIG. 6. In the alternate embodiment using the orientation tool 38 of FIG. 4, the ground firing surface 70 of the ground electrode 34 is disposed on the support surface 90 of the receptacle 88.

Once the shell 24 is disposed on the orientation tool 38, the method includes locating the ground electrode 34 by rotating the shell 24 relative to the orientation tool 38 such that the ground firing surface 70 slides along the tool outer surface 82 circumferentially around the central axes $a_i$, $a_t$ until the side surface 66 of the ground electrode 34 contacts the thread orientation feature 84 and is disposed in a predetermined position relative to the thread orientation feature 84, as shown in FIG. 7. In the alternate embodiment using the orientation tool 38 of FIG. 4, the ground firing surface 70 slides along the support surface 90 of the receptacle 88 until sliding into the slot and engaging the thread orientation feature 84, which is the slot surface.

Once the ground electrode 34 is positioned correctly in the thread forming apparatus 102, the method includes forming the threads 26 in the shell outer surface 64 in the predetermined location relative to the ground electrode 34, for example using the thread dies 76. The side surface 66 of the ground electrode 34 is maintained in contact with the thread orientation feature 84 until the thread forming apparatus 102 begins to form the threads 26 in the shell 24. Next, the method includes forming the threads 26 in the shell 24 at the predetermined angle $\alpha$ relative to the ground electrode 34. The thread forming apparatus 102 is programmed to form the threads 26 at the predetermined angle $\alpha$.

The method next includes disengaging the threaded shell 24 and ground electrode 34 from the orientation tool 38, and proceeding to form the remainder of the spark plug 20. In one embodiment, the further steps include bending the ground firing surface 70 of the ground electrode 34 inwardly toward the igniter central axis $a_i$, sliding the insulator 30 into the shell 24, sliding the central electrode 32 into the insulator 30, disposing the resistor layer 58 in the insulator 30 along the central electrode 32, and disposing the terminal 52 in the insulator 30 on the resistor layer 58.

After forming the spark plug 20, the method includes threading the spark plug 20 into the cylinder head 28 or another component maintaining the spark plug 20 in position during the end application. The cylinder head 28 includes threads 26 mating the threads 26 of the shell 24. The method includes engaging the threads 26 of the shell 24 and the threads 26 of the cylinder head 28, and rotating the shell 24 relative to the cylinder head 28 to screw the shell 24 into the cylinder head 28. When the shell 24 is threaded into the cylinder head 28, the ground electrode 34 will be disposed in the predetermined location relative to the threads 26 of the shell 24 and thus in an optimal location relative to the cylinder head 28, fuel injector, and other components of the combustion chamber of the internal combustion engine, allowing the spark plug 20 to provide a more reliable and efficient ignition of the fuel-air mixture in the combustion chamber 22.

Figure 9:
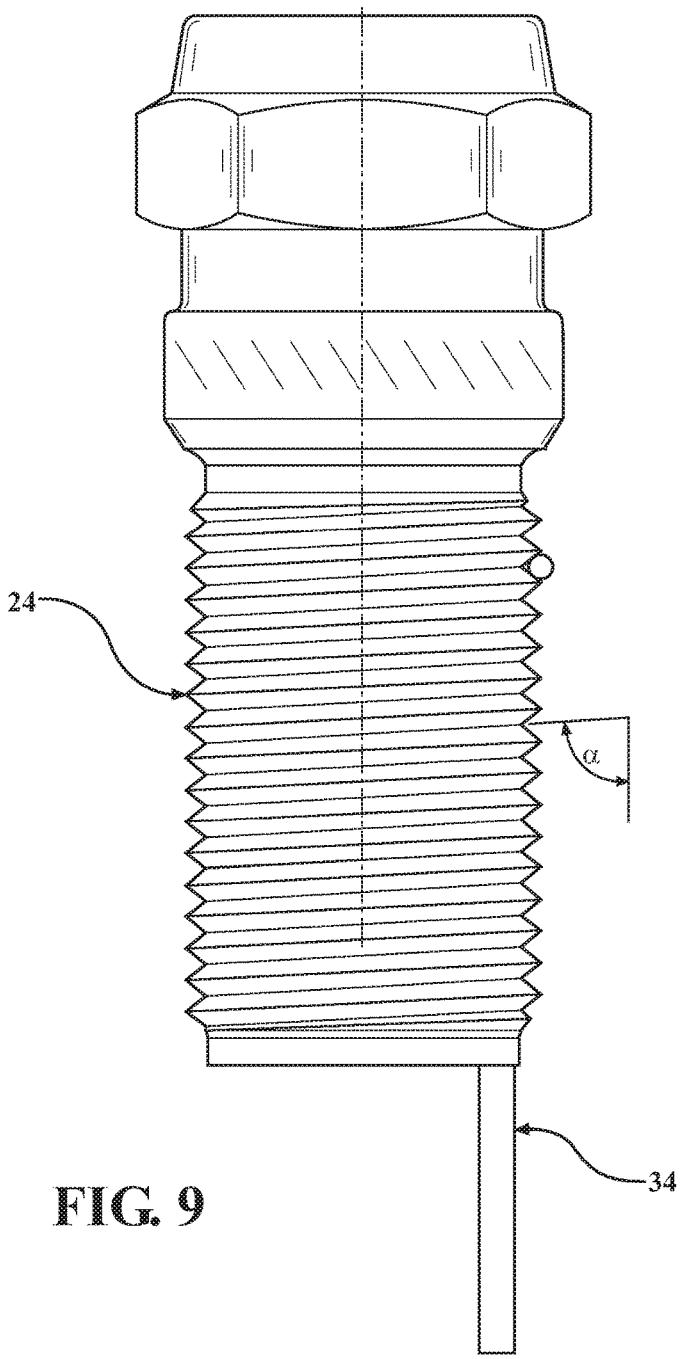
FIG. 9 is a side view of an example threaded spark plug and ground electrode formed according to the first, second, or third alternate method.
Figure 10:
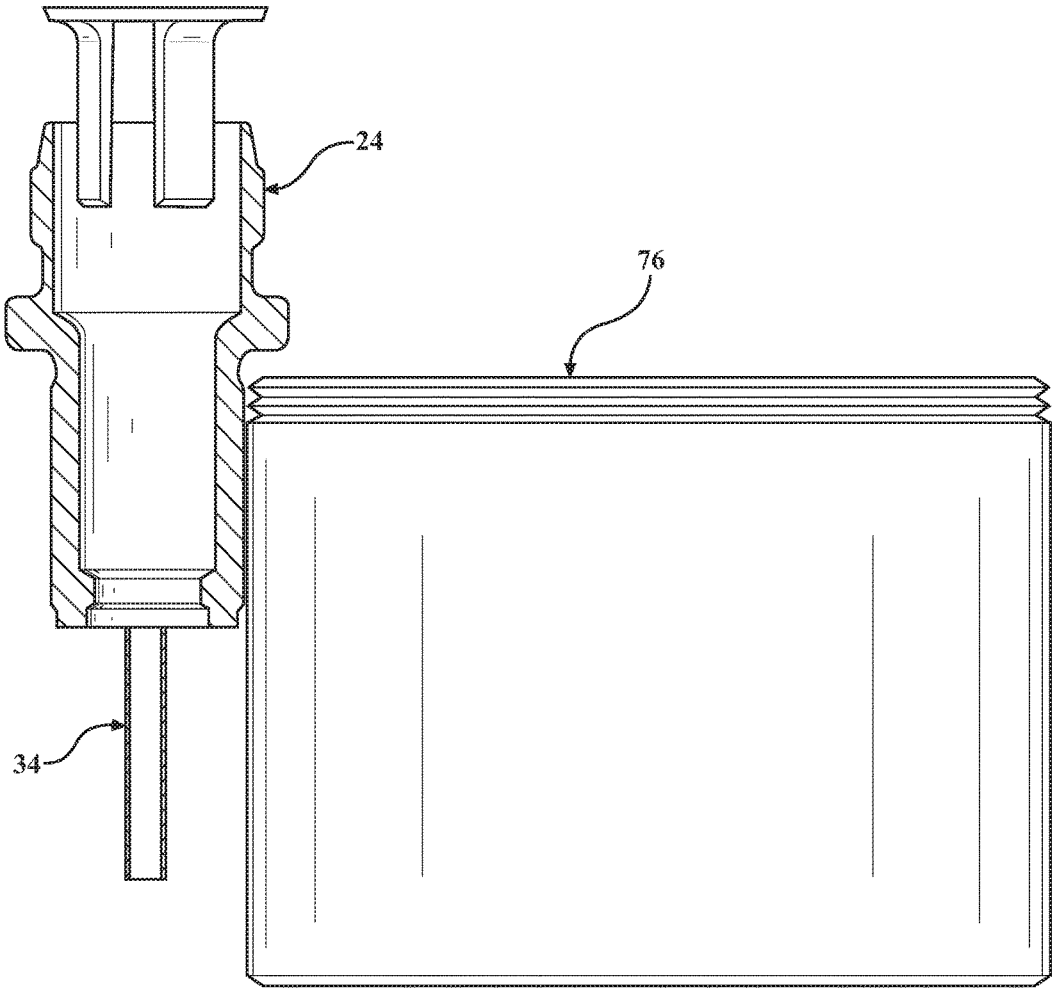
FIG. 10 is a side view of an example threaded shell and ground electrode disposed adjacent a threading die used in the first alternate method.
Figure 11:
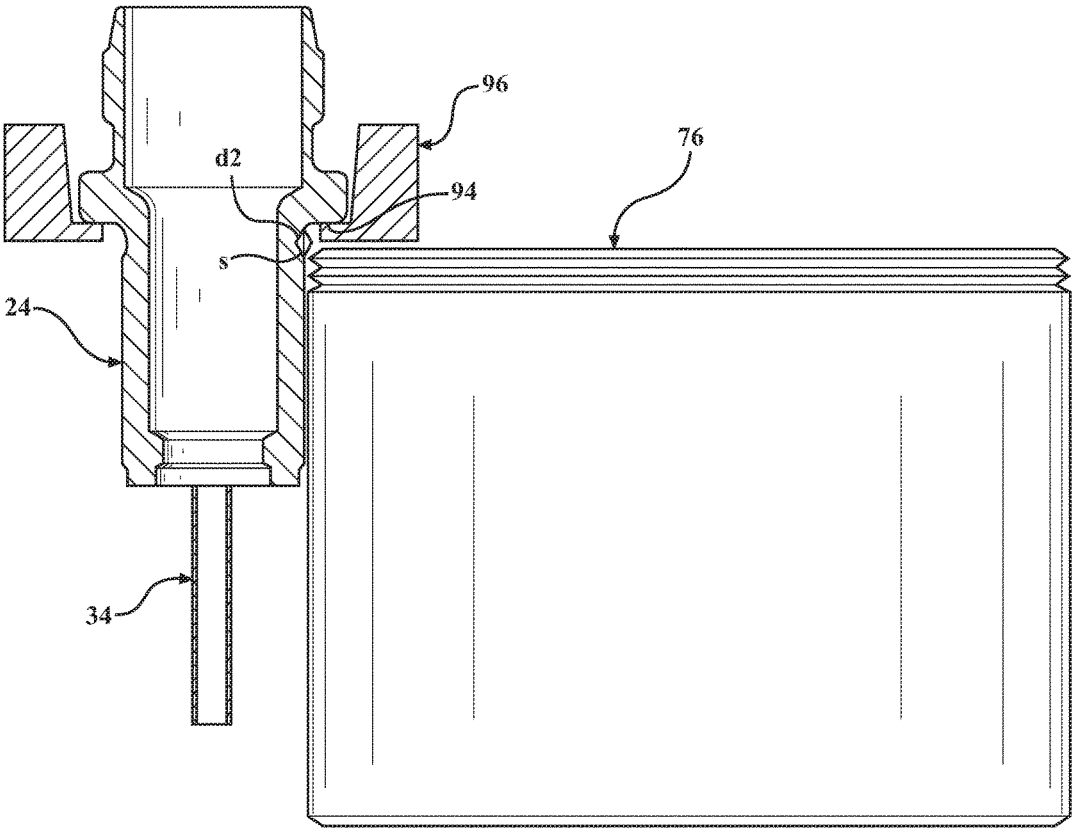
FIG. 11 is a side view of an example threaded shell and ground electrode disposed adjacent a threading die used in the second alternate method.
Figure 12:
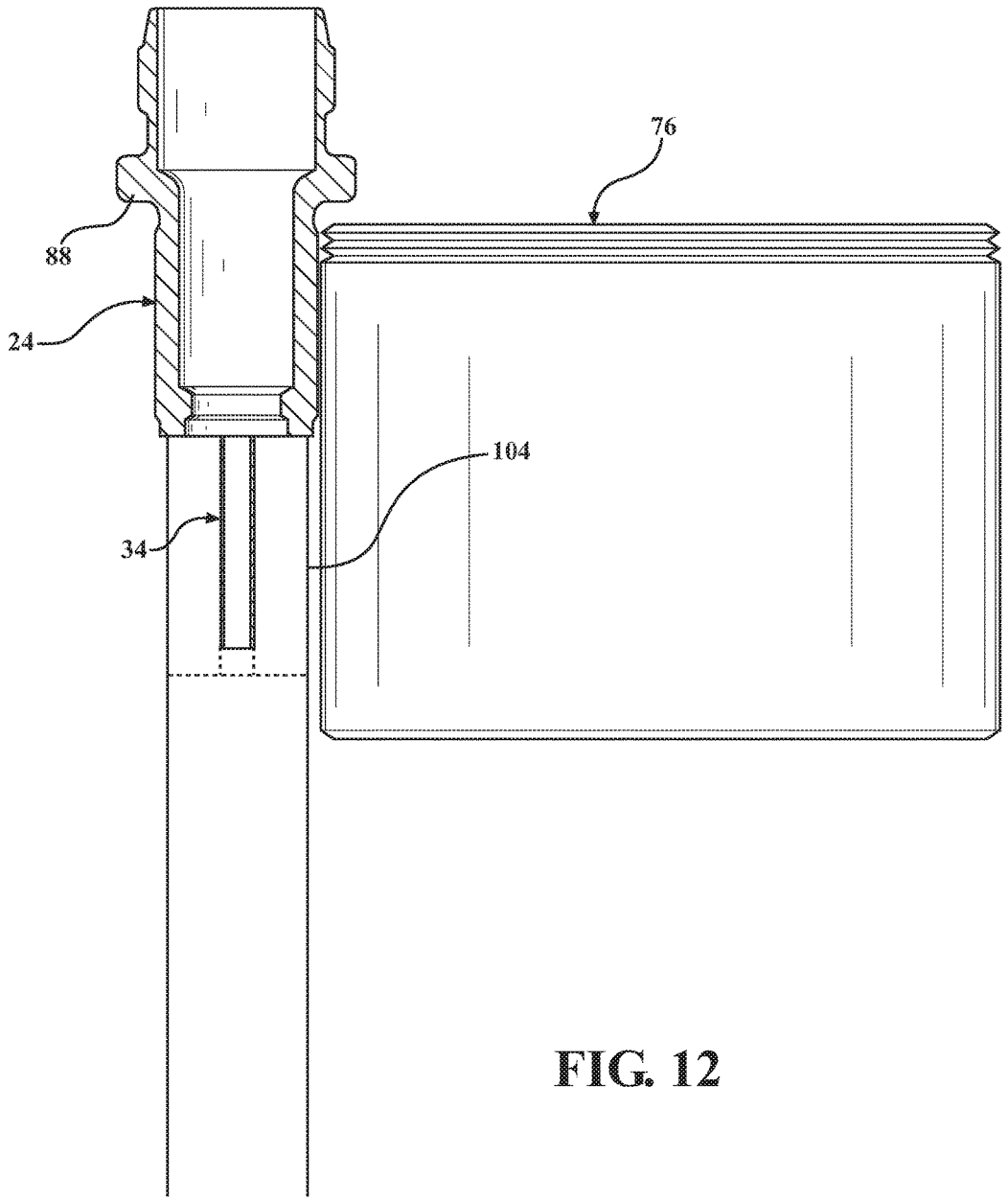
FIG. 12 is a side view of an example threaded shell and ground electrode disposed adjacent a threading die used in the third alternate method.

Three alternate methods of forming the threads 26 in the shell outer surface 64 are also provided. The alternate methods are capable of reliably and repeatedly orienting the threads 26 at the desired, predetermined rotational angle $\alpha$ and in a desired start position s, which is especially advantageous when manufacturing multiple spark plugs 20 of the same design. Examples of the threaded shell 24 and ground electrode 34 formed according to these alternate methods are generally shown in FIGS. 8 and 9. FIG. 10 illustrates an example of the shell 24 and ground electrode 34 relative to one of the dies 76 of the thread forming apparatus 102 according to the first alternate method. FIG. 11 illustrates an example of the shell 24 and ground electrode 34 relative to one of the dies 76 of the thread forming apparatus 102 according to the second alternate method. FIG. 12 illustrates an example of the shell 24 and ground electrode 34 relative to one of the dies 76 of the thread forming apparatus 102 according to the third alternate method. In addition, it is noted that individual or multiple steps of the methods of the three embodiments could be combined to create another embodiment of the method of orienting the threads 26 at the desired rotational position $\alpha$ and in the desired start position s. These methods provide for improved thread indexing accuracy, so that the threads 26 of the multiple shells 24 can be repeatedly located in an optional location relative to the cylinder head 28, fuel injector, and other components of the internal combustion engine.

The alternate methods begin by positioning the ground electrode 34 in a desired position outside of the thread forming apparatus 102, i.e. before the shell 24 and ground electrode 34 are disposed in the thread forming apparatus 102. Typically, the attachment surface 68 of the ground electrode 34 is already attached to the shell lower surface 36 along the shell lower surface 36 and so that the ground electrode 34 extends longitudinally from the attachment surface 68. However, the method can include attaching the attachment surface 68 of the ground electrode 34 to the shell lower surface 36 at a predetermined circumferential location along the shell lower surface 36 and so that the ground electrode 34 extends longitudinally from the attachment surface 68 before disposing the shell 24 between the threading dies 76. The predetermined circumferential location of the ground electrode 34 is selected so that the ground electrode 34 will be disposed in a desired position in the thread forming apparatus 102 which helps to maintain a consistent relationship between the known rotational position of the ground electrode 34, the start position s of the threads, and the predetermined rotational position α of the threads 26 to create a ground electrode 34 capable of repeating its rotation location inside a combustion chamber, for example a position providing effective combustion. Once the ground electrode 34 is positioned, the improved thread indexing method begins.

According to the first alternate method, after the ground electrode 34 is oriented, the method includes determining a location of a ledge 88 of a shell seat 86 which extends perpendicular to the center axis A of the shell 24, faces the shell lower surface 36, and rests on the gasket or on a surface within the combustion chamber of the engine. If the spark plug 20 being manufactured will be used with the gasket, the ledge 88 of the shell seat 86 comes into contact with the gasket, which typically contacts the mating surface of the cylinder head 28. If the spark plug 20 being manufactured is not used with the gasket, then the ledge 88 of the shell seat 86 typically comes in contact with the mating surface of the cylinder head 28.

The method of the first embodiment next includes determining the start position s of the threads 26 to be formed in the shell outer surface 64 relative to the ledge 88 of the shell seat 86. The start position of the threads 26 is also based on a desired location of the shell 24 in the cylinder head 28. The method further includes determining the predetermined rotational position α of the threads 26 in the shell outer surface 64 and determining the known rotational position of the ground electrode 34 relative to the start position s of the threads 26 to be formed in the shell outer surface 64. These steps can be conducted by determining the location of a gage point g of the shell 24 in relation to a stating location of the top of the threading dies 76. The gage point g can be a radial diameter reference point, as shown in FIGS. 8 and 9, or a reference point anywhere else on the shell 24 that relates to the contact point of the mating surface of the final assembly position of the spark plug application. Whether or not the spark plug 20 is used with the gasket, the gage point g can be determined by creating a datum line at a specified diameter on the ledge 88, related to the contact position of the mating surface in the application. The gage point g can be located outside of the thread forming apparatus 102 off a hard contact point located at a known relative distance to the stating location of the top of the threading dies 76 by a known distance, vision or other measurement system. Alternatively, the location of the gage point g can be determined fully by vision or other measurement system inside, or outside, the threading apparatus 102. The entire shell 24 or spark plug 20 can be designed based on the desired location of the ground electrode 34 rotational position, gage point g, and thread start position s relative to the cylinder head 28 of the engine in which the spark plug 20 will be used. In addition, the start position s and predetermined rotational position α of the threads 26 is designed so that the ground electrode 34 is disposed in a desired position when threaded into the cylinder head 28 of the combustion chamber, for example a position providing effective combustion. The gage point g, starting location of the threads of the threading dies 76, and the ground electrode 34 rotational placement can be referenced from the thread start position s.

After the position of the ledge gage point g is determined, the first alternate method includes picking up the shell 24 with the ground electrode 34 oriented, and holding the shell 24 while placing the shell 24 between the threading dies 76 of the thread forming apparatus 102. FIG. 10 illustrates an example of the shell 24 disposed adjacent one of the threading dies 76 of the thread forming apparatus 102 according to the first alternate embodiment. This step includes placing the shell 24 and the attached ground electrode 34 between the set of threading dies 76 of the thread forming apparatus 102 so that the ledge 88 of the shell seat 86 is at a specified distance relative to the starting location of the threads of the threading dies 76, and clamping the shell 24 with the threading dies 76. The step of placing the shell 24 and the attached ground electrode 34 between the set of threading dies 76 also includes placing the shell 24 and the attached ground electrode 34 at the known rotational position in relation to the start position s of the threads 26 to be formed in the shell outer surface 64. The method can further include disposing the ground electrode 34 rotational position and the gage point g at a specified distance d1 relative to the start position s of the threads 26 to be formed by threading dies 76. The start position s is important as it relates to the contact point of the shell 24 with the cylinder head 28, which controls the indexing position of the spark plug 20 in the engine. The specified distance d1 is determined based on the design of the cylinder head 28 in which the spark plug 20 will be used. For example, the specified distance d1 in relation to the ground electrode rotational position can be replicated onto the threads of the cylinder head 28 to position the placement of the ground electrode 34 in the combustion chamber. The threading dies 76 should not be too high relative to the shell seat ledge 88, otherwise there is the possibility of scratching the shell outer surface 64, which can lead to leakage of combustion gases. Also, the dies 76 are positioned and set to rotate at a predetermined rotational position and speed so that when multiple spark plugs 20 of the same design are manufactured, the predetermined rotational position α of the threads 26 on the dies 76 is in the same repeated position.

The step of determining the predetermined rotational position α of the threads 76 in the shell outer surface 64 and thus the rotational position of the threads of the dies 76 can be done theoretically by calculating the distance d1 from the gage point g on the ledge 88 to the threads 26 in relation to the rotational position of the ground electrode 34. Alternatively, once the threads 26 are located at the start position s, i.e. the desired height in the thread relief, this step can include measuring the degree, or the circumferential location, of the ground electrode 34 in relation to the gage point g and rotational position α of the threads 76 in the shell outer surface 64 with a coordinate measuring machine (cmm), hard gage tool, or vision measurement system, and adjusting the position of the dies 76 accordingly. Once the predetermined rotational position α of the threads 26 is determined, the method also typically includes forming the threads 26 in the cylinder head 38 in which the spark plug 20 will be used at a rotational position corresponding to the predetermined rotational position α of the threads 26 in the shell outer surface 64 so that the ground electrode 34 is ultimately located at the correct radial position when the shell 24 is threaded in the cylinder head 38 of the engine.

The method next includes clamping the shell 24 with the dies 76 to lock in the start position s of the threads 26 relative to the ledge 88 of the shell 24. Next, the method includes rotating the dies 76 to form the threads 26 at the predetermined rotational position α in the shell outer surface 64. The method can also include moving the threading dies 76 in the longitudinal direction while they are rotating, for example towards the center of the shell 24, to form the correct thread parameters. Once the threads 26 are formed, the threaded shell 24 is removed from the thread forming apparatus 102 and then combined with the other components of the spark plug 20. After the threading step, the dies 76 return to a specified initial position, so that they are ready to thread another shell 24. The specified initial position of the dies 76 is repeated to form multiple shells 24 and/or spark plugs 20 having the same design.

The method of the second embodiment also includes determining the start position s of the threads 26 in the shell outer surface 64. The second alternate method further includes determining the predetermined rotational position α of the threads 26 in the shell outer surface 64, and thus the rotational position of the threads of the dies 76 used to form the threads 26 in the shell outer surface 64. The dies 76 are positioned and set to rotate at a predetermined rotational position and speed so that when multiple spark plugs 20 of the same design are manufactured, the rotational position of the threads 26 on the dies 76 is in the same repeated position. The step of determining the predetermined rotational position α of the threads 76 in the shell outer surface 64 and thus rotational position of the threads in the dies 76 can be done theoretically by calculating the distance dl from the gage point g to the threads 26 in relation to the rotational position of the ground electrode 34. Alternatively, once the threads 26 are located at the start position s, i.e. the desired height in the thread relief, this step can include measuring the degree of the ground electrode 34 in relation to the gage point g and rotational position α of the threads 76 in the shell outer surface 64 with a coordinate measuring machine (cmm), hard gage tool, or vision measurement system, and adjusting the position of the dies 76 accordingly. Once the predetermined rotational position α of the threads 26 is determined, the method also typically includes forming the threads 26 in the cylinder head 38 in which the spark plug 20 will be used at the correct rotational position so that the ground electrode 34 is ultimately located at the correct radial position inside the cylinder head 38 of the engine.

After locating the ground electrode 34, the method includes picking up the shell 24 with the ground electrode 34 oriented in a predetermined circumferential location, and holding the shell 24 while placing the shell 24 between the threading dies 76 of the thread forming apparatus 102. FIG. 11 illustrates an example of the shell 24 disposed adjacent one of the threading dies 76 of the thread forming apparatus 102 according to the second alternate method.

Unlike the method of the first embodiment, the step of disposing the shell 24 and the attached ground electrode 34 between the threading dies 76 according to the second embodiment includes engaging the ledge 88 of the shell seat 86 with a surface 94 between the dies 76 which is disposed at a specified distance d2 relative to the start position s of the threads 26. This surface 94 contacts the gage point g on the shell seat ledge 88. The specified distance d2 depends on the design of the cylinder head 38 in which the spark plug 20 is used. The step of determining the start position s is based on a desired location of the shell 24 in the cylinder head 28. The start position s is again important as it relates to the contact point of the shell 24 with the cylinder head 38, which controls the indexing position of the spark plug 20 in the engine. This step includes making sure that the threads 26 are high enough into the thread relief area on the shell 24 so that the shell 24 fully threads into the cylinder head 28. The surface 94 can be provided by an interchangeable insert 96, as shown in FIG. 11, capable of holding the gasket or the ledge 88 of the shell seat 86, which can be tapered. Alternatively, the surface 94 can be provided by another solid surface capable of maintaining the shell 24 at the specified distance d2 relative to the start position s of the threads 26. For example, the top of one of the threading dies 76 or another material located on top of the dies 76 could be used to provide the surface 94.

The surface 94 can remain in position during the threading step, and thus is typically formed from a material resistant to scratching and scarring the gasket or the ledge 88 of the shell seat 86. Alternatively, the surface 94 can be moved to a lower position spaced from the ledge 88 prior to the threading step. Scratching and scarring should be avoided, as scratches and scars could prevent sealing of the spark plug 20 in relation to the gasket or the ledge 88 and thus could cause combustion gases to escape the combustion chamber.

The method further includes clamping the shell 24 with the dies 76 to lock in the start position s of the threads 26 relative to the ledge 88 of the shell 24 and the rotational position of the ground electrode 34. Next, the method includes rotating the dies 76 and forming the threads 26 at the predetermined rotational position α in the shell outer surface 64. Once the threads 26 are formed, the threaded shell 24 is removed from the thread forming apparatus 102 and then combined with the other components of the spark plug 20. After the threading step, the dies 76 return to a specified initial position, and the surface 94 is brought back to its specified initial position, if moved, so that the thread forming apparatus 102 is ready to thread another shell 24. The specified initial position of the surface 94 and the dies 76 is repeated to forming multiple shells 24 and/or spark plugs 20 having the same design.

The third example embodiment also includes providing the shell 24 with the ledge 88 of the shell seat 86 facing the shell lower surface 36, and providing the ground electrode 34 extending longitudinally from the attachment surface 68. The method of the third embodiment further includes determining the longitudinal location of the ledge 88 of the shell seat 86, which is the distance between the shell lower surface 36 and the ledge 88. This can be done outside or inside the threading forming apparatus 102 by vision or other measurement system. The method also includes placing the attached ground electrode 34 at the known rotational position in relation to the start position s of the threads 26 to be formed in the shell outer surface 64 before disposing the shell 24 between the dies 76.

The method next includes placing the shell 24 and the attached ground electrode 34 between the threading dies 76 of the thread forming apparatus 102 so that the ledge 88 of the shell seat 86 is at a specified distance relative to the starting position of the threads of the threading dies 76. The step of placing the ledge 88 of the shell seat 86 at the specified distance relative to the starting position of the threads of the threading dies 76 includes disposing the shell lower surface 36 on a solid adjustment feature 104 located between the dies 76, and adjusting the location of the solid adjustment feature 104 relative to the starting position of the threads of the dies 76. For example, a mechanism can be used to adjust the position of the solid adjustment feature 104 in the longitudinal direction, i.e. move the solid adjustment feature 104 up or down, to a specific distance to position the shell seat ledge 88 at the correct distance from the start of the dies 76. The top surface of the solid adjustment feature 104 can either have a cutout to clear the ground electrode 34 or it can have a slot cut into it to help locate the ground electrode 34 at a tighter rotational angle.

As in the other embodiments, the third embodiment includes clamping the shell 24, and rotating the threading dies 76 to form the threads 26 at the predetermined rotational position α in the shell outer surface 64. The dies 76 are at a specific repeatable rotational position, and the solid adjustment feature 104 is lowered out of the way of the rotating shell 24 or rotates freely while the shell 24 rotates during the threading operation. The threaded shell 24 is then ejected and the process is started over again. The processing of the third embodiment can be the same as the other embodiments, besides determining the height location of the shell seat 88 and the use of the solid adjustment feature 104 between the dies 76 that the shell lower surface 36 contacts to maintain the correct distance from the shell seat ledge 88 to the starting position of the threads of the dies 76.

As indicated above, the main components of the improved alternate methods are the position of the ledge 88, gage point g, orientation of the ground electrode 34, start position s of the threads 26 on the shell 24 and the starting position of the threads on the dies 76, the specified distance d1, the specified distance d2 of the surface 94, and the clamping position. In summary, the method includes locating the ground electrode 34 outside of the thread forming apparatus 102, rather than internally, starting the threads of the dies 76 at the repeated start position s along the shell outer surface 64, and clamping the shell 24 between the dies 76 in relation to a set distance from the ledge 88 gage point g. The factures, which are typically determined before the threading step, accurately control the index threading position.

Obviously, many modifications and variations of the present invention are possible in light of the above teachings and may be practiced otherwise than as specifically described while within the scope of the appended claims. In addition, the reference numerals in the claims are merely for convenience and are not to be read in any way as limiting.

The invention claimed is:

1. A method of threading a shell for a spark plug of an internal combustion engine, comprising the steps of:

providing a shell extending to a shell lower surface and including a shell outer surface, the shell including a shell seat presenting a ledge facing the shell lower surface;

providing a ground electrode extending longitudinally from an attachment surface, wherein the attachment surface of the ground electrode is attached to the shell lower surface before disposing the shell and the ground electrode in a thread forming apparatus;

determining a start position of threads to be formed in the shell outer surface relative to the ledge of the shell seat, the step of determining the start position of the threads being based on a desired location of the shell in the cylinder head;

determining a predetermined rotational position of the threads in the shell outer surface;

placing the shell and the attached ground electrode between a set of threading dies of the thread forming apparatus;

the step of placing the shell between the set of threading dies including disposing the ledge at a specified distance relative to a starting position of threads of the threading dies; and rotating the threading dies to form the threads at the predetermined rotational position in the shell outer surface.

2. A method according to claim 1 including determining a longitudinal location of the ledge of the shell seat, which is the distance between the shell lower surface and the ledge.

3. A method according to claim 1, wherein at least one of a circumferential location of the ground electrode, the start position of threads to be formed in the shell outer surface, the predetermined rotational position of the threads in the shell outer surface is determined by a gage point located at the ledge of the shell seat.

4. A method according to claim 3, wherein the gage point is determined by creating a datum line at the ledge.

5. A method according to claim 3, wherein the step of determining the predetermined rotational position of the threads in the shell outer surface includes calculating a distance from the gage point to the threads in relation to the circumferential location of the ground electrode.

6. A method according to claim 3, wherein the step of determining the predetermined rotational position of the threads in the shell outer surface includes measuring the circumferential location of the ground electrode in relation to the gage point.

7. A method according to claim 1 including returning the threading dies to a specified initial position, and setting the dies to rotate at a predetermined rotation angle and speed in preparation to thread another shell.

8. A method according to claim 1, wherein the step of placing the shell and the attached ground electrode between a set of threading dies of the thread forming apparatus includes engaging the ledge of the shell seat with a surface located between the dies, the surface being disposed at a specified distance relative to the start position of the threads to be formed in the shell outer surface.

9. A method according to claim 8, wherein the surface engaged by the ledge is provided by an interchangeable insert, one of the threading dies, or a material disposed on one of the threading dies.

10. A method according to claim 1, wherein the step of placing the shell and the attached ground electrode between a set of threading dies of the thread forming apparatus includes disposing the ledge at a specified distance relative to a starting position of threads of the threading dies.

11. A method according to claim 10, wherein the step of disposing the ledge at the specified distance relative to the starting position of threads of the threading dies includes disposing the shell lower surface on a solid adjustment feature located between the dies, and adjusting the location of the solid adjustment feature relative to the starting position of the threads of the dies.

12. A method according to claim 11, wherein a top surface of the solid adjustment feature has a cutout to accommodate the ground electrode or a slot to locate the ground electrode.

13. A method according to claim 1 including clamping the shell between the threading dies to lock in the start position of the threads relative to the ledge of the shell.

14. A method according to claim 1 including moving the threading dies in a longitudinal directly during the rotating step.

15. A method according to claim 1 including returning the threading dies to a specified initial position and setting the dies to rotate at a predetermined rotation angle and speed in preparation to thread another shell.

16. A method according to claim 1 including forming a plurality of the threaded shells by repeating the steps of providing the shell and ground electrode, determining a start position of threads and the predetermined rotational position of the threads in the shell outer surface, placing the shell and the attached ground electrode between the set of threading dies, and rotating the threading dies, and wherein after each of the rotating steps, the dies return to a specified initial position for threading another shell, wherein the start position of the threads on the shell outer surface and the predetermined rotational position of the threads is the same in each of the threaded shells formed.

17. A method according to claim 1, wherein the location and predetermined rotational position of the threads allows the ground electrode to be disposed in a desired position when the ground electrode is threaded into a cylinder head.

18. A method of manufacturing at least one spark plug of an internal combustion engine, comprising the steps of:

providing a shell extending to a shell lower surface and including a shell outer surface, the shell including a shell seat presenting a ledge facing the shell lower surface;

providing a ground electrode extending longitudinally from an attachment surface, wherein the attachment surface of the ground electrode is attached to the shell lower surface before disposing the shell and the ground electrode in a thread forming apparatus;

determining a start position of threads to be formed in the shell outer surface relative to the ledge of the shell seat, the step of determining the start position of the threads being based on a desired location of the shell in the cylinder head;

determining a predetermined rotational position of the threads in the shell outer surface;

placing the shell and the attached ground electrode between a set of threading dies of the thread forming apparatus;

the step of placing the shell between the set of threading dies includes disposing the ledge at a specified distance relative to a starting position of threads of the threading dies; and rotating the threading dies to form the threads at the predetermined rotational position in the shell outer surface.

19. A method according to claim 18 including disposing a central electrode and an insulator in the shell.

20. A method of manufacturing an internal combustion engine, comprising the steps of:

providing a shell extending to a shell lower surface and including a shell outer surface, the shell including a shell seat presenting a ledge facing the shell lower surface;

providing a ground electrode extending longitudinally from an attachment surface, wherein the attachment surface of the ground electrode is attached to the shell lower surface before disposing the shell and the ground electrode in a thread forming apparatus;

determining a start position of threads to be formed in the shell outer surface relative to the ledge of the shell seat, the step of determining the start position of the threads being based on a desired location of the shell in the cylinder head;

determining a predetermined rotational position of the threads in the shell outer surface;

placing the shell and the attached ground electrode between a set of threading dies of the thread forming apparatus;

the step of placing the shell between the set of threading dies includes disposing the ledge at a specified distance relative to a starting position of threads of the threading dies; and rotating the threading dies to form the threads at the predetermined rotational position in the shell outer surface. forming a spark plug including the threaded metal shell and the attached ground electrode; and forming threads in a cylinder head at an angle corresponding to the predetermined rotational position in the shell outer surface so that the ground electrode is located at a desired radial position when the shell is threaded in the cylinder head.

* * * * *